US009329573B2

(12) United States Patent
Wyssbrod

(10) Patent No.: US 9,329,573 B2
(45) Date of Patent: May 3, 2016

(54) BELOW DIAL HAND FITTING

(71) Applicant: ETA SA Manufacture Horlogere Suisse, Grenchen (CH)

(72) Inventor: Baptist Wyssbrod, Nidau (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/382,166

(22) PCT Filed: Feb. 21, 2013

(86) PCT No.: PCT/EP2013/053446

§ 371 (c)(1),
(2) Date: Aug. 29, 2014

(87) PCT Pub. No.: WO2013/127686

PCT Pub. Date: Sep. 6, 2013

(65) Prior Publication Data

US 2015/0078145 A1 Mar. 19, 2015

(30) Foreign Application Priority Data

Feb. 29, 2012 (EP) ..... 12157574

(51) Int. Cl.
*G04B 19/06* (2006.01)
*G04B 19/02* (2006.01)
*G04B 19/04* (2006.01)

(52) U.S. Cl.
CPC ..... *G04B 19/06* (2013.01); *G04B 19/02* (2013.01); *G04B 19/044* (2013.01)

(58) Field of Classification Search
CPC ..... G04B 19/00; G04B 19/02; G04B 19/04; G04B 19/044; G04B 19/06
See application file for complete search history.

(56) References Cited

U.S. PATENT DOCUMENTS 4,378,957 A 4/1983 Malkin et al.
4,805,161 A * 2/1989 Kroner ..... 368/220

(Continued)

FOREIGN PATENT DOCUMENTS

DE 40 32 879 4/1991
DE 196 41 894 4/1998

(Continued)

OTHER PUBLICATIONS

International Search Report Issued Apr. 19, 2013 in PCT/EP13/053446 Filed Feb. 21, 2013.

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

A timepiece movement driving at least one output arbor for receiving an indicator displaying a physical or temporal magnitude facing and above a complementary indicator or a dial, the complementary indicator or dial being arranged on a local reference or bearing surface included locally in the movement about of each the output arbor of the movement, or being arranged on the local reference or bearing surface. The output arbor includes, on a side of a local reference or bearing surface thereof, a free end which is either recessed or flush with respect to the local reference or bearing surface thereof.

13 Claims, 2 Drawing Sheets

(56) References Cited

U.S. PATENT DOCUMENTS

| | | | | |
|---|---|---|---|---|
| 5,506,820 | A * | 4/1996 | Honzawa et al. | 368/220 |
| 5,844,863 | A | 12/1998 | Voss et al. | |
| 5,889,738 | A * | 3/1999 | Huter | 368/220 |
| 2004/0105346 | A1 * | 6/2004 | Lang | 368/80 |
| 2005/0078561 | A1 * | 4/2005 | Endo et al. | 368/280 |
| 2008/0130419 | A1 | 6/2008 | Watanabe et al. | |
| 2009/0154301 | A1 * | 6/2009 | Sakamaki et al. | 368/220 |
| 2010/0322036 | A1 * | 12/2010 | Crettex et al. | 368/80 |
| 2013/0044574 | A1 * | 2/2013 | Kaelin et al. | 368/318 |

FOREIGN PATENT DOCUMENTS

| | | |
|---|---|---|
| EP | 0 862 098 | 9/1998 |
| EP | 1 826 636 | 8/2007 |
| JP | 62 19788 | 1/1987 |

* cited by examiner

BELOW DIAL HAND FITTING

CROSS-REFERENCE TO RELATED APPLICATIONS

This is a National Phase Application in the United States of International Patent application PCT/EP2013/053446 filed Feb. 21, 2013 which claims priority on European Patent Application No. 12157574.0 filed Feb. 29, 2012. The entire disclosures of the above patent applications are hereby incorporated by reference.

FIELD OF THE INVENTION

The invention concerns a timepiece movement driving at least one output arbor for receiving an indicator displaying a physical or temporal magnitude facing and above at least one complementary indicator or a dial arranged on a local reference or bearing surface locally comprised in said movement or on said local reference or bearing surface, said at least one output arbor including, on the side of said local reference or bearing surface, a free end which is either recessed or flush with respect to said local reference or bearing surface.

The invention also concerns a modular timepiece assembly including at least one such timepiece movement.

The invention also concerns a timepiece formed from a modular assembly of this type.

The invention concerns the field of horology, and more specifically the field of visual display mechanisms.

BACKGROUND OF THE INVENTION

The design of a timepiece movement generally endeavours to create a common platform, on the basis of which it is possible to offer a variety of different, multi-option variants. The objective is therefore to ensure that the components of the basic movement do not interfere with those of any of the proposed variants, so that the movement can be used as it is, without disassembling or exchanging any components, and personalisation options are achieved simply by adding additional components. In particular, for the positioning of seconds displays, notably centre seconds or off-centre small seconds, the objective is to avoid being able to mount different arbors for each option, while also ensuring that the unused arbors do not create any interference with the dial, or the hands or the crystal.

Conventionally, centre displays include concentric, stepped cannon-pinions and arbors, all protruding above the surface of the dial, and the same holds true for small seconds arbors, which project above the level of the dial. Versatile usage therefore entails a dial having as many orifices as there are options for positioning small seconds arbors, or other current time display functions, or timing functions, or other functions, which detracts from the attractiveness of the timepiece.

DE Patent Application No 19641894A1 in the name of Hillgruber describes the fitting of hands to a cannon-pinion or arbor via a helical spring, said spring being contained in an external guide tube.

EP Patent Application No 0862098A2 in the name of Voss describes a modular watch with annular fittings for the hands.

U.S. Pat. No. 4,378,957A in the name of Malkin describes a seconds arbor pivoting in a bearing of the cannon-pinion, the axial stops of the other cannon-pinions being formed by their drive wheels.

DE Patent Application No 4032879A1 in the name of Yazaki Corp describes the relative axial cooperation of tubes and cannon-pinions via annular grooves and flanges.

SUMMARY OF THE INVENTION

The invention proposes to improve the economical and aesthetic creation of variants constructed on the same basic movement, without requiring the interposition of additional plates, which are detrimental to the thickness of the timepiece and whose cost makes such variants more expensive.

To this end, the invention concerns a timepiece movement driving at least one output arbor for receiving an indicator displaying a physical or temporal magnitude facing and above at least one complementary indicator or a dial arranged on a local reference or bearing surface locally comprised in said movement or on said local reference or bearing surface, said at least one output arbor including, on the side of said local reference or bearing surface, a free end which is either recessed or flush with respect to said local reference or bearing surface, characterized in that said output arbor includes a stop surface intended to ensure said recessed arrangement in all operating configurations, and whose travel is limited, either by a complementary stop surface comprised in said structure or by a fixed cross-piece inserted between said structure and said output arbor.

According to a feature of the invention, said movement includes at least one main output arbor which is coaxial to a main cannon-pinion which has one cannon-pinion end protruding relative to said movement, and, on the side of said protruding cannon-pinion end, said main output arbor has an end which is either recessed or flush with respect to said protruding cannon-pinion end.

According to a feature of the invention, each said at least one output arbor of said movement which is not coaxial to a main cannon-pinion includes, on the side of said local reference or bearing surface, one end which is either recessed or flush with respect to said local reference or bearing surface.

According to a feature of the invention, each said at least one main output arbor of said movement which is coaxial to a main cannon-pinion which has one cannon-pinion end protruding with respect to said movement includes, on the side of said protruding cannon-pinion end, an end which is either recessed or flush with respect to said protruding cannon-pinion end.

According to a feature of the invention, each said at least one output arbor of said movement which is not coaxial to a main cannon-pinion includes, on the side of said local reference or bearing surface, an end which is either recessed or flush with respect to said local reference or bearing surface, and each said at least one main output arbor of said movement which is coaxial to a main cannon-pinion which includes a cannon-pinion end protruding with respect to said movement includes, on the side of said protruding cannon-pinion end, an end which is either recessed or flush with respect to said protruding cannon-pinion end.

According to a feature of the invention, said protruding end of said main cannon-pinion is either recessed or flush with respect to said local reference or bearing surface.

According to a feature of the invention, said protruding end of each said main cannon-pinion is either recessed or flush with respect to said local reference or bearing surface.

The invention also concerns a modular timepiece assembly including at least one timepiece movement of this type, characterized in that the assembly includes a plurality of dials each including a complementary surface bearing on an upper surface comprised in said movement, and in that the assembly also includes, for each said particular dial, a particular set of display indicators which are each intended to be assembled to one of the output arbors and/or main output arbors comprised in said movement and which remain visible through orifices in said particular dial after the assembly of said dial on said movement.

The invention also concerns a timepiece formed from a modular assembly of this type, characterized in that the timepiece includes, assembled on an upper surface of said movement, a particular dial or a unique juxtaposition of said particular dials and, assembled to said movement through said particular dial or said unique juxtaposition of said particular dials, a plurality of said display indicators each assembled on one of the output arbors and/or main output arbors comprised in said movement and which remain visible through orifices comprised in said particular dial or comprised in said unique juxtaposition of said particular dials, after the assembly thereof on said movement.

The invention therefore makes it possible to equip a basic movement with a plurality of dials, or sets of dials, each specific to a particular variant and to equip the free arbor ends on each dial with suitable display indicators, notably hands.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
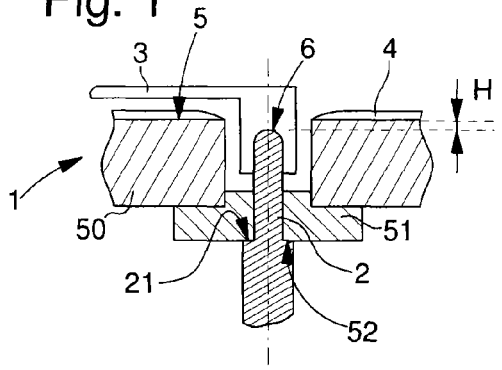
FIG. 1 shows, in a schematic, partial cross-section through the axis of a first type of output arbor of a movement according to the invention, a detail of said movement.

The invention concerns the field of horology, and more specifically the field of visual display mechanisms.

More specifically, this specification and the Figures illustrate the preferred, non-limiting example of a display via hands, for which the invention proposes fitting hands under the dial.

The invention concerns a timepiece movement 1 driving at least one output arbor 2 or 7 for receiving an indicator 3 displaying a physical or temporal magnitude facing and above at least one complementary indicator or a dial 4. This complementary indicator or dial 4 is arranged, either on a local reference or bearing surface 5 of a structure 50, such as a main plate or bar or similar, comprised locally in movement 1 about each output arbor 2 or 7 comprised therein, or is arranged on local reference of bearing surface 5.

According to the invention, as seen in FIG. 1, this at least one output arbor is of a first type 2 and includes, on the side of its local reference or bearing surface 5, a free end 6 which is either recessed by a value H from or flush with its local reference or bearing surface 5.

This output arbor of the first type 2 has a stop surface 21 which is intended to ensure this recessed (or possibly flush) arrangement in all operating configurations, and whose travel is limited, either by a complementary stop surface 52 comprised in structure 50, or by a fixed cross-piece 51 inserted between structure 50 and the output arbor of the first type 2.

Preferably, the output arbor of the first type 2 or of the second type 7, thus includes a stop surface 21 or 71 intended to ensure the recessed arrangement in all operating configurations, taking account of any foreseeable expansion. The travel of stop surface 21 or 71 is limited, either by a complementary stop surface 52 comprised in structure 50 or a fixed cross-piece 51 inserted between structure 50 and the output arbor of the first type 2 or of the second type 7, or by a complementary stop surface 91 comprised in a cannon-pinion 8 into which the arbor of the first type 2, or second type 7 is inserted, as seen in FIGS. 1, 2, 2A and 3, which illustrate various non-limiting variants of the invention.

Figure 2:
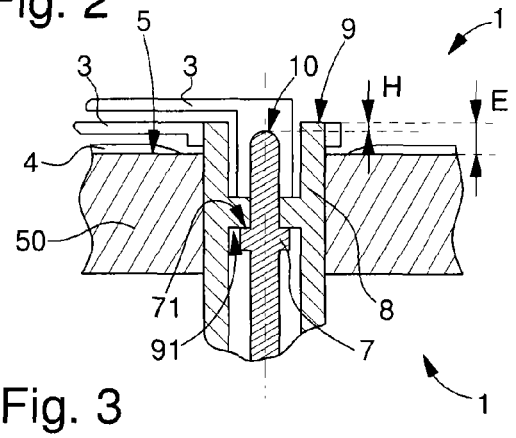
FIG. 2 shows, in a similar manner, a detail in cross-section through the axis of a second type of main output arbor coaxial to a cannon-pinion.
Figure 2A:
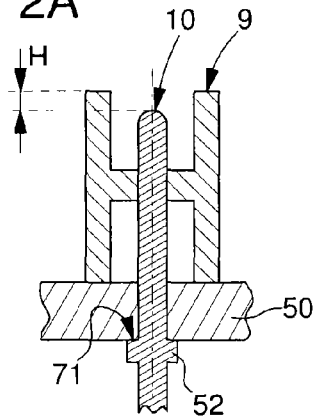
FIG. 2A shows another variant of FIG. 2.

In a particular embodiment seen in FIG. 2, movement 1 includes at least one second type 7 of main output arbor, which is coaxial to a main cannon-pinion 8 which includes a protruding cannon-pinion end 9 which projects by a value E in relation to local reference or bearing surface 5. Also, the main output arbor of the second type 7 includes, on the side of this protruding cannon-pinion end 9, a free end 10 which is either recessed by a value H from, or flush with protruding cannon-pinion end 9. It is understood that this is not the arbor of the first type 2 of FIG. 1 since the latter has a free end 6 recessed or flush with respect to local reference or bearing surface 5, which is not the case of the main output arbor of the second type 7.

In a particular variant, each at least one output arbor of the first type 2 of movement 1, which is not coaxial to a main cannon-pinion 8 has, on the side of the local reference or bearing surface 5, a free end 6 which is either recessed or flush with respect to its local reference or bearing surface 5.

It is not, however, necessary for the movement of the invention to include a plurality of output arbors and/or main output arbors.

In a particular variant, each at least one main output arbor of the second type 7 of movement 1, which is coaxial to a main cannon-pinion 8 which has a cannon-pinion end 9 protruding relative to its local reference or bearing surface 5 includes, on the side of protruding cannon-pinion end 9, a free end 10, which is either recessed or flush with respect to protruding cannon-pinion end 9.

In an advantageous embodiment, each at least one output arbor of the first type 2 of movement 1 which is not coaxial to a main cannon-pinion 8 includes, on the side of its local reference or bearing surface 5, a free end 6 which is either recessed or flush with respect to its local reference or bearing surface 5, and each at least one main output arbor of the second type 7 of movement 1 which is coaxial to a main cannon-pinion 8 which has a cannon-pinion end 9 protruding relative to its local reference or bearing surface 5 includes, on the side of said protruding cannon-pinion end 9, a free end 10 which is either recessed or flush with respect to said protruding cannon-pinion end 9.

Figure 3:
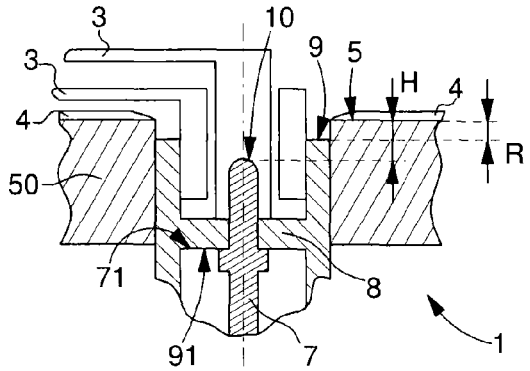
FIG. 3 shows yet another variant of FIG. 2.

In a particular variant seen in FIG. 3, the protruding end 9 of main cannon-pinion 8 is either recessed by a value R from or flush with the local reference or bearing surface 5 which surrounds the main arbor 7 of the second type coaxial to main cannon-pinion 8 and which surrounds main cannon-pinion 8.

In a particular variant, the protruding end 9 of each main cannon-pinion 8 is either recessed or flush with respect to its local reference or bearing surface 5.

Figure 4:
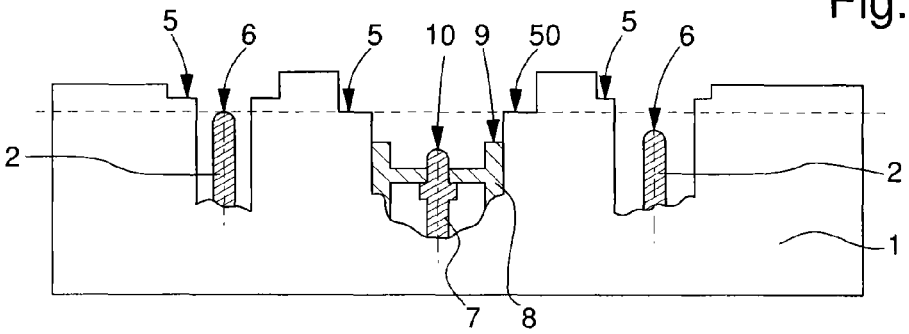
FIG. 4 shows a schematic, partial, broken cross-section through the axes of several output arbors of a movement according to the invention.

In a particular variant, as seen in FIG. 4, the free end 6 or 10 of each output arbor of the first type 2 or of each main output arbor of the second type 7 comprised in movement 1 is either recessed or flush with respect to a plane tangent to a local reference or bearing surface 5 which is the furthest from free ends 6, 10.

In a particular embodiment, all the local reference or bearing surfaces 5 on each output arbor of the first type 2 or on each main output arbor of the second type 7 comprised in movement 1 are aligned.

Figure 5:
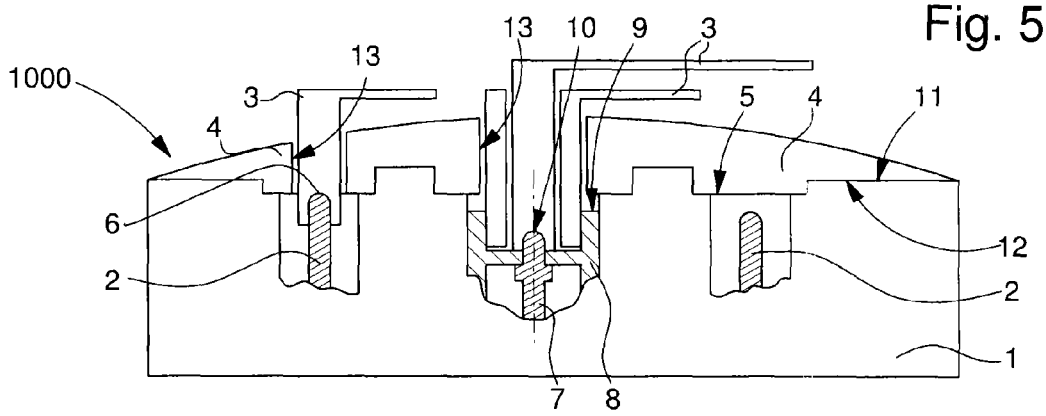
FIG. 5 shows, in a similar manner to FIG. 4, a timepiece incorporating the movement of FIG. 4.

Preferably, timepiece movement 1 includes an upper surface 11 for receiving and holding in position at least one dial 4, which bears on upper surface 11 via a complementary surface 12 comprised in said at least one dial 4. Said at least one dial 4 includes a series of orifices 13 allowing the assembly of display indicators 3 on only certain of the output arbors of the first type 2 and/or of the main output arbors of the second type 7 comprised in movement 1, and said at least one dial 4 conceals those of output arbors 2 and/or of main output arbors of the second type 7 which are not visible through orifices 3 as shown in FIG. 5.

Preferably, recess H is around 0.20 mm.

Preferably, the output arbor of the first type 2 or second type 7 is equipped with an output indicator 3 formed by a hand. This output indicator may also be formed by a disc, a sector or suchlike.

Figure 6:
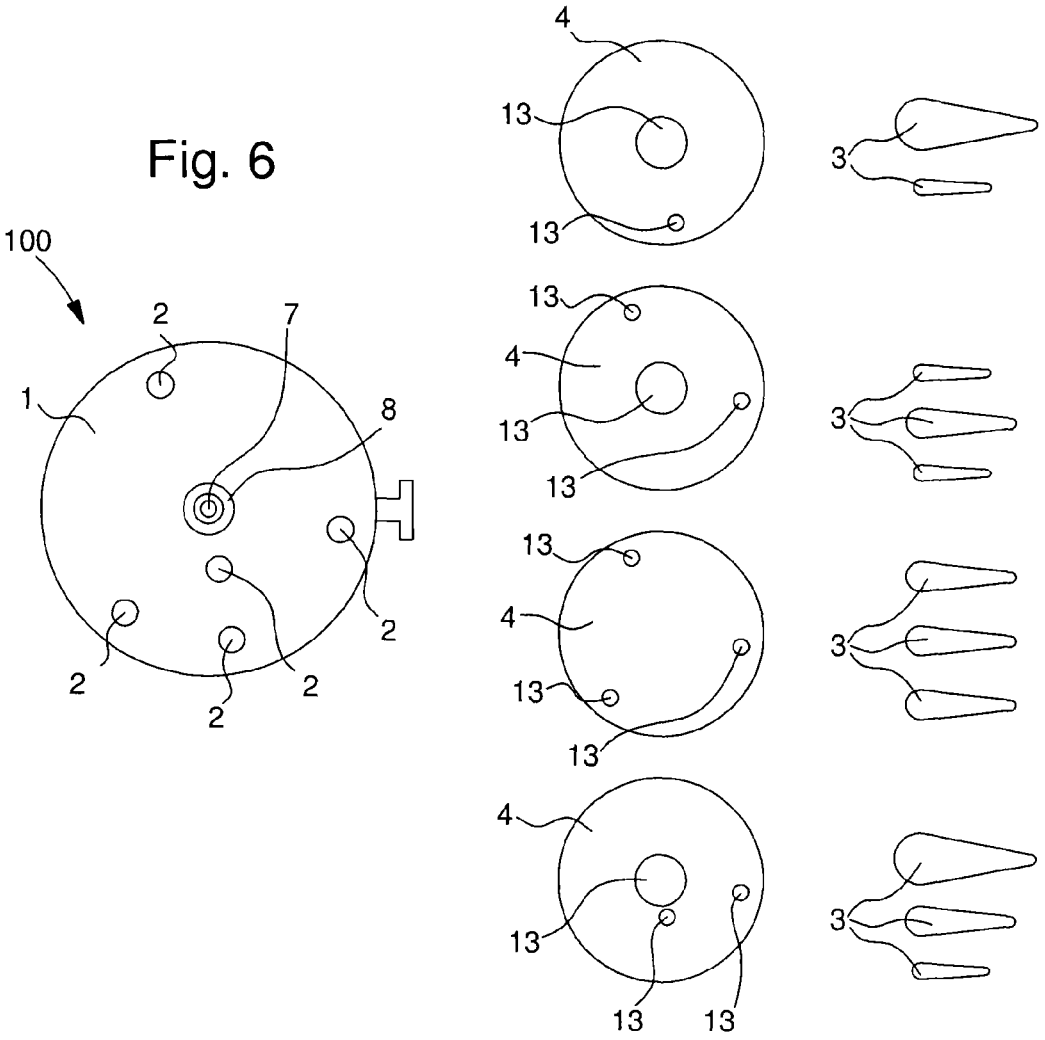
FIG. 6 shows a schematic, front, exploded view of the composition of a modular assembly kit according to the invention.
Figure 7:
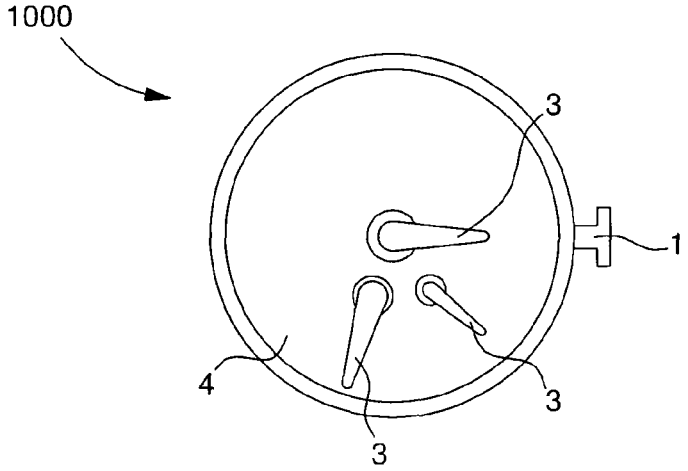
FIG. 7 shows a schematic, front view of a timepiece assembled using a set of components from a modular kit of FIG. 6.

The invention also concerns a modular timepiece assembly 100 including at least one such timepiece movement 1. According to the invention, the assembly includes a plurality of dials 4 each including a complementary surface 12 bearing on an upper surface 11 of movement 1, and further includes, for each particular dial 4, a particular set of display indicators 3 which are each intended to be assembled on one of the output arbors of the first type 2 and/or main output arbors of the second type 7 comprised in movement 1, and which remain visible through orifices 13 comprised in the particular dial 4 after the assembly of dial 4 on movement 1. FIG. 6 illustrates a kit of this type, from which particular combinations of components can be taken to assemble different timepieces 1000.

The invention also concerns a timepiece 1000 of this type formed from a modular assembly 100 of this type. According to the invention, the timepiece includes, assembled on an upper surface 11 of movement 1, a particular dial 4 or a unique juxtaposition of particular dials 4 and, assembled to movement 1 through the particular dial 4 or unique juxtaposition of particular dials 4, a plurality of display indicators 3 each assembled on one of the output arbors of the first type 2 and/or of the main output arbors of the second type 7 comprised in movement 1 and which remain visible through orifices 13 comprised in the particular dial 4 or comprised in the unique juxtaposition of particular dials 4, after the assembly thereof on movement 1.

Although it can be used for all the usual hour, minute, second and date displays, the invention is particularly well suited to a small seconds type display. In the usual constructions, the small seconds is in the line of the going train and its position cannot easily be modified. The construction according to the invention avoids any additional gear trains, and provides a versatile movement allowing a large variety of different displays, which makes it possible to form an extensive collection at a reasonable cost.

The invention therefore makes it possible to rationalise production costs, to create, from the same movement, numerous timepieces with differing dials, differing display architecture, or differing functions or complications offered to the user.

The invention claimed is:

1. A timepiece movement, comprising:

at least one first output arbor that the movement drives, and the first output arbor receives an indicator displaying a physical or temporal magnitude facing and above a complementary indicator or a dial, the complementary indicator or dial being arranged on a local reference or bearing surface comprised locally in a structure of the movement about the first output arbor of the movement, the first output arbor including, on a side of the local reference or bearing surface, a free end which is either recessed or flush with respect to the local reference or bearing surface, wherein the first output arbor includes a stop surface configured to ensure a recessed arrangement in all operating configurations, and whose travel is limited, either by a complementary stop surface included in the structure of the movement or by a fixed cross-piece inserted between the structure of the movement and the first output arbor.

2. The timepiece movement according to claim 1, wherein the movement further comprises at least one second main output arbor, the second main output arbor is coaxial to a main cannon-pinion which includes a protruding cannon-pinion end which protrudes relative to a respective local reference or bearing surface, and the second main output arbor includes, on a side of the protruding cannon-pinion end, a respective free end which is either recessed or flush with respect to the protruding cannon-pinion end.

3. The timepiece movement according to claim 2, wherein each of the at least one second main output arbor of the movement which is coaxial to a respective main cannon-pinion which includes a cannon-pinion end protruding relative to a respective local reference or bearing surface includes, on the side of the protruding cannon-pinion end a respective free end which is either recessed or flush with respect to the protruding cannon-pinion end.

4. The timepiece movement according to claim 2, wherein each of the at least one first output arbor of the movement which is not coaxial to a main cannon-pinion includes, on a side of a respective local reference or bearing surface, a respective free end which is either recessed or flush with respect to the respective local reference or bearing surface, and wherein each of the at least one second main output arbor of the movement which is coaxial to a respective main cannon-pinion which includes a cannon-pinion end protruding relative to another respective local reference or bearing surface includes, on the side of the protruding cannon-pinion end, a respective free end which is either recessed or flush with respect to the protruding cannon-pinion end.

5. The timepiece movement according to claim 2, wherein the free end of each of the at least one first output arbor or of each of the at least one second main output arbor comprised in the movement is either recessed or flush with respect to a plane tangent to one local reference or bearing surface which is furthest from the free ends.

6. The timepiece movement according to claim 2, wherein all of the local reference or bearing surfaces on each of the at least one first output arbor or on each of the at least one second main output arbor comprised in the movement are aligned.

7. The timepiece movement according to claim 2, wherein the movement includes an upper surface to receive and hold in position at least one dial which bears on the upper surface via a complementary surface included in the at least one dial, and the at least one dial includes a series of orifices allowing an assembly of the display indicators on only certain of the at least one first output arbor and/or the at least one second main output arbor included in the movement, and the at least one dial conceals those of the at least one first output arbor and/or of the at least one second main output arbor which are not visible through the orifices.

8. The timepiece movement according to claim 2, wherein the at least one first output arbor or the at least one second output arbor includes a hand.

9. A modular timepiece assembly comprising at least one timepiece movement according to claim 2, wherein the assembly includes a plurality of dials each including a complementary surface bearing on an upper surface included in the movement, and the assembly also includes, for each dial, a set of display indicators configured to be assembled to one of the at least one first output arbor and/or the at least one second main output arbor included in the movement and which remain visible through orifices in the dial after assembly of the dial on the movement.

10. A timepiece formed from a modular assembly according to claim 9, wherein the timepiece includes, assembled on an upper surface of the movement, a dial or a unique juxtaposition of the dial and, assembled to the movement through the dial or the unique juxtaposition of the particular dial, a plurality of the display indicators each assembled on one of the at least one first output arbor and/or the at least one second main output arbor comprised in the movement and which remain visible through orifices included in the dial or in the unique juxtaposition of the dial, after assembly thereof on the movement.

11. The timepiece movement according to claim 1, wherein each of the at least one first output arbor of the movement, which is not coaxial to a main cannon-pinion includes, on a side of a respective local reference or bearing surface, a respective free end which is either recessed or flush with respect to the respective local reference or bearing surface.

12. The timepiece movement according to claim 1, wherein the movement further comprises at least one second main output arbor, the second main output arbor is coaxial to a main cannon-pinion which includes a protruding cannon-pinion end which is either recessed or flush with respect to a respective local reference or bearing surface, and the second main output arbor includes, on a side of the protruding cannon-pinion end, a respective free end which is either recessed or flush with respect to the protruding cannon-pinion end, which surrounds the second main arbor coaxial to the main cannon-pinion, and which surrounds the main cannon-pinion.

13. The timepiece movement according to claim 12, wherein the protruding end of each of the main cannon-pinion is either recessed or flush with respect to the respective local reference or bearing surface.

* * * * *